US008063574B2

(12) United States Patent
Lai et al.

(10) Patent No.: US 8,063,574 B2
(45) Date of Patent: Nov. 22, 2011

(54) LIGHT EMITTING DIODE ILLUMINATING DEVICE

(75) Inventors: Chih-Ming Lai, Miao-Li Hsien (TW); Chun-Wei Wang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 460 days.

(21) Appl. No.: 12/344,645

(22) Filed: Dec. 29, 2008

(65) Prior Publication Data

US 2009/0190354 A1 Jul. 30, 2009

(30) Foreign Application Priority Data

Jan. 30, 2008 (CN) ..... 2008 1 0300275

(51) Int. Cl.
*H05B 41/16* (2006.01)

(52) U.S. Cl. ..... 315/246; 315/309; 315/360

(58) Field of Classification Search ..... 315/246, 315/291, 309, 360; 362/249.01, 249.02
See application file for complete search history.

(56) References Cited

U.S. PATENT DOCUMENTS

| | | | | |
|---|---|---|---|---|
| 7,344,279 | B2 * | 3/2008 | Mueller et al. | 362/294 |
| 7,538,499 | B2 * | 5/2009 | Ashdown | 315/309 |
| 7,731,417 | B2 * | 6/2010 | Kumagai | 374/1 |
| 7,741,825 | B2 * | 6/2010 | Lenz | 323/284 |
| 2007/0105212 | A1 * | 5/2007 | Oldham et al. | 435/288.7 |

FOREIGN PATENT DOCUMENTS

| | | | |
|---|---|---|---|
| CN | 2745312 | Y | 12/2005 |
| CN | 101001491 | A | 7/2007 |

* cited by examiner

*Primary Examiner* — Thuy Vinh Tran
(74) *Attorney, Agent, or Firm* — Altis Law Group, Inc.

(57) ABSTRACT

An exemplary light emitting diode illuminating device includes a light emitting diode (LED) light source, a heat dissipating device, a temperature detector, a power supply and a pulse width modulator. The heat dissipating device is thermally connected to the LED light source. The temperature detector is thermally connected to the LED light source and configured for detecting the working temperature of the LED light source. The power supply is electrically connected to the pulse width modulator for providing electric power to the pulse width modulator. The pulse width modulator has a direct current (DC) output mode and a pulse output mode.

10 Claims, 4 Drawing Sheets

LIGHT EMITTING DIODE ILLUMINATING DEVICE

BACKGROUND

1. Technical Field

The present invention generally relates to illuminating devices and, particularly, to a light emitting diode (LED) illuminating device capable of maintaining a stable working temperature.

2. Discussion of Related Art

Nowadays, light emitting diodes (LEDs) have been used extensively as light source for illuminating devices due to their high luminous efficiency and low power consumption.

However, radiant efficiency and lifespan of the LEDs may be distinctly reduced by high working temperature, thereby easily leads to low reliability of illuminating device employing the same.

Therefore, what is needed is a light emitting diode (LED) illuminating device capable of maintaining a stable working temperature.

BRIEF DESCRIPTION OF THE DRAWINGS

Many aspects of the present light emitting diode illuminating device can be better understood with reference to the following drawings. The components in the drawings are not necessarily drawn to scale, the emphasis instead being placed upon clearly illustrating the principles of the present light emitting diode illuminating device.

DETAILED DESCRIPTION OF THE EMBODIMENTS

Reference will now be made to the drawings to describe the embodiments of the present light emitting diode illuminating device, in detail.

Figure 1:
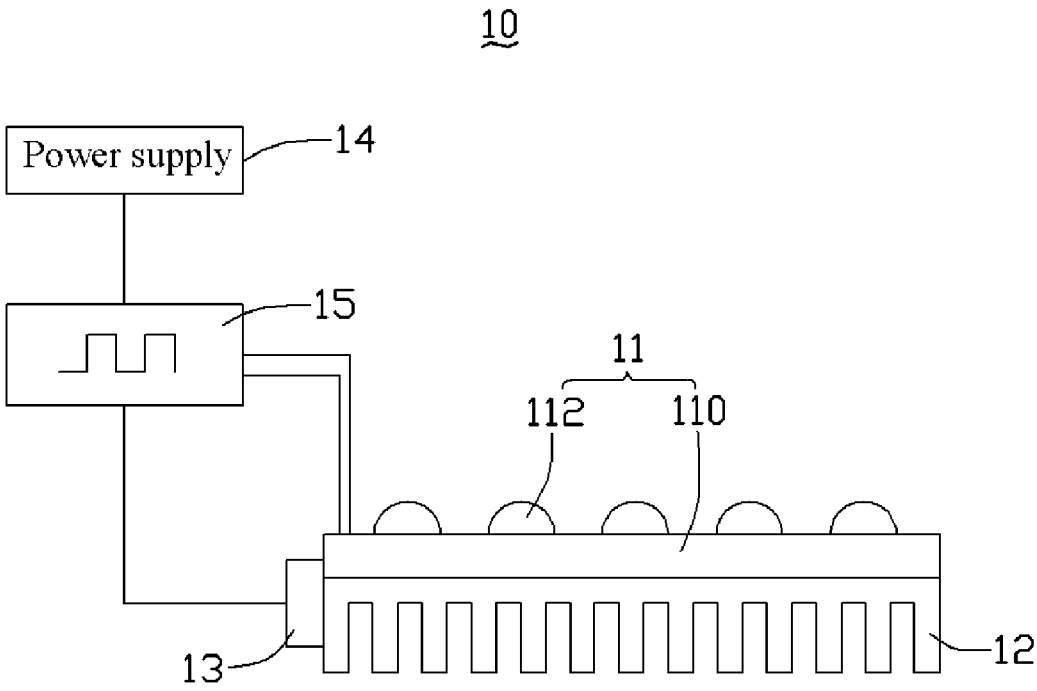
FIG. 1 is a schematic view of the structure of a light emitting diode illuminating device, according to an exemplary embodiment.

Referring to FIG. 1, a light emitting diode (LED) illuminating device 10, according to an exemplary embodiment, is provided. The LED illuminating device 10 includes a LED light source 11, a heat dissipating device 12, a temperature detector 13, a power supply 14 and a pulse width modulator 15.

The LED light source 11 includes a substrate 110 and at least one LED 112 mounted on the substrate 110. The substrate 110 has electrical circuit (not illustrated) formed therein, thereby electric power can be provided to the LED 112 via the electrical connection of the electrical circuit, and the positive and negative electrode of the LED 112. Heat generated by the LED 112 will be conducted to the substrate 110.

The heat dissipating device 12 is thermally connected to the LED light source 11, thereby for dissipating heat generated by the LED light source 11. In this exemplary embodiment, the heat dissipating device 12 includes a plurality of fins configured at a side of the substrate 110 opposite to the LED 112.

The temperature detector 13 is thermally connected to the LED light source 11, thereby detects a working temperature of the LED source 11. The temperature detector 13 can be thermally connected to LED light source 11 or the heat dissipating device 12, for example mounted on the substrate 110 or the heat dissipating device 12. In this exemplary embodiment, the temperature detector 13 is thermally connected to the joint of the substrate 110 and the heat dissipating device 12. The temperature detector 13 can be a thermal couple.

The power supply 14 is electrically connected to the pulse width modulator 15 and provides electric power to the pulse width modulator 15. The power supply 14 can be a current source or a voltage source. In this exemplary embodiment, the power supply 14 is a direct current source.

The pulse width modulator 15 is configured for operating at a direct current (DC) current output mode or a pulse output mode.

Figure 2:
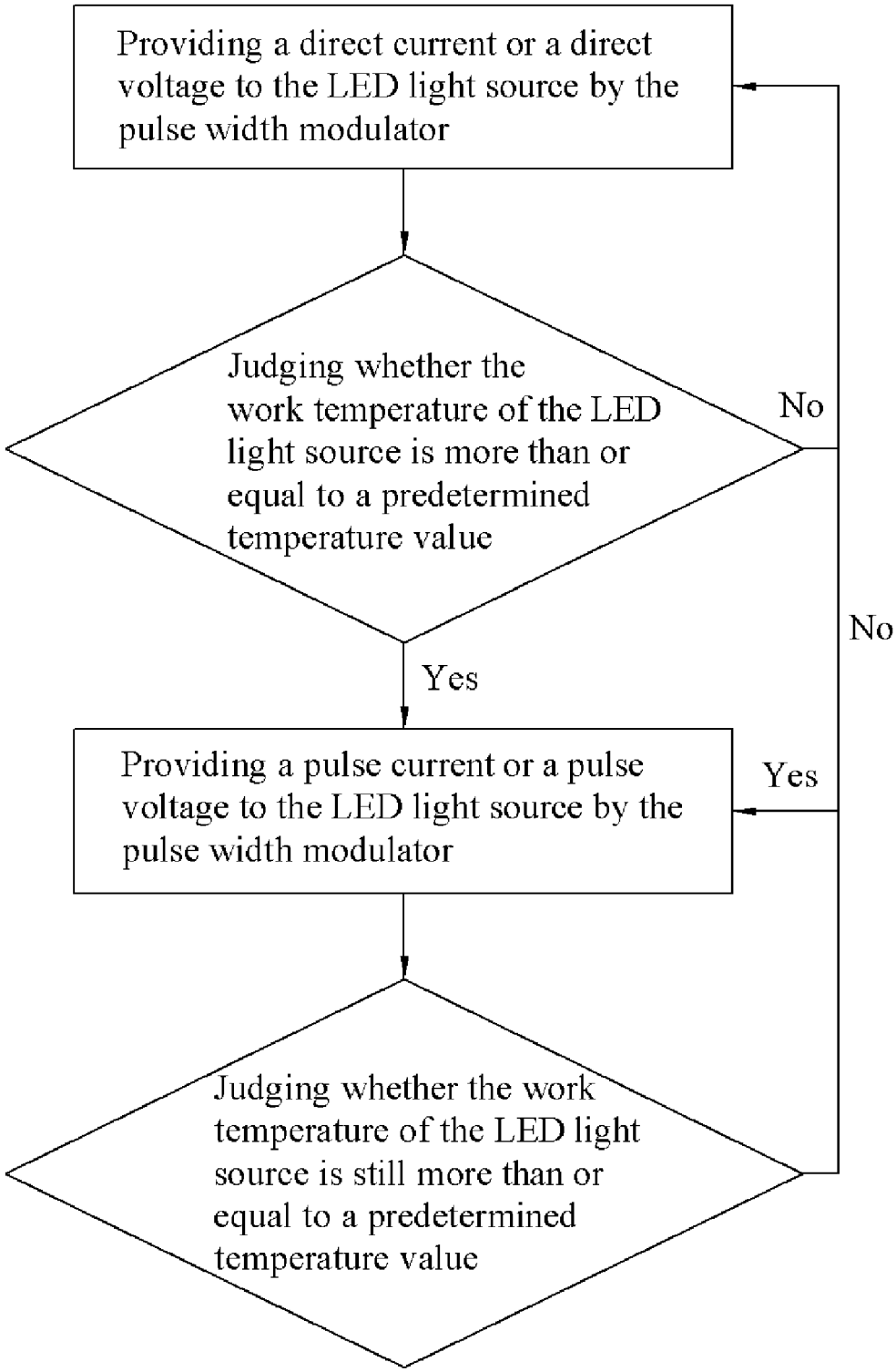
FIG. 2 is a schematic logic view of the light emitting diode illuminating device of FIG. 1.

Referring to FIG. 2, working principle of the LED illuminating device 10 is showed below.

In the beginning, the pulse width modulator 15 operates at DC output mode, thereby provides a direct current or a direct voltage to the LED light source 11. At this time, the working temperature of the LED light source 11 gradually increases. The heat generated by the LED light source 11 transfers to the heat dissipating device 12 via the substrate 110.

The temperature detector 13 detects the working temperature of the LED light source 11 and compares the working temperature with a predetermined temperature. In this exemplary embodiment, the working temperature is a temperature of the substrate 110 and the heat dissipating device 12; and the predetermined temperature is 120 degrees centigrade.

If the working temperature of the LED light source 11 is lower than 120 degree centigrade, the pulse width modulator 15 continues to operate at the DC output mode and provide the direct current or the direct voltage to the LED light source 11.

If the working temperature of the LED light source 11 is higher than or equal to 120 degrees centigrade, the temperature detector 13 sends a first trigger signal to the pulse width modulator 15 to switch the pulse width modulator 15 to operates at a pulse output mode. As such, the pulse width modulator 15 provides a pulse current or pulse voltage to the LED light source 11. Generally, the pulse current or pulse voltage has a frequency higher than or equal to 60 hertz, so that the flash of the LED light source 11 can not be sensed by people.

When the LED light source 11 is supplied with pulse current or pulse voltage, less heat is generated by the LED light source 11 and the working temperature thereof correspondingly decreases. If the working temperature of the LED light source 11 is lower than 120 degrees centigrade, the temperature detector 13 sends a second trigger signal to the pulse width modulator 15 to switch the pulse width modulator 15 back to the DC output mode.

The temperature detector 13 continues to detect the working temperature of the LED light source 11 and comparing the working temperature with the predetermined temperature.

The output mode of pulse width modulator 15 can be switched according to the working temperature of the LED illuminating device 10. As such, the LED illuminating device 10 is capable of maintaining a stable working temperature. Moreover, the LED illuminating device 10 has lower power consumption.

Figure 3:
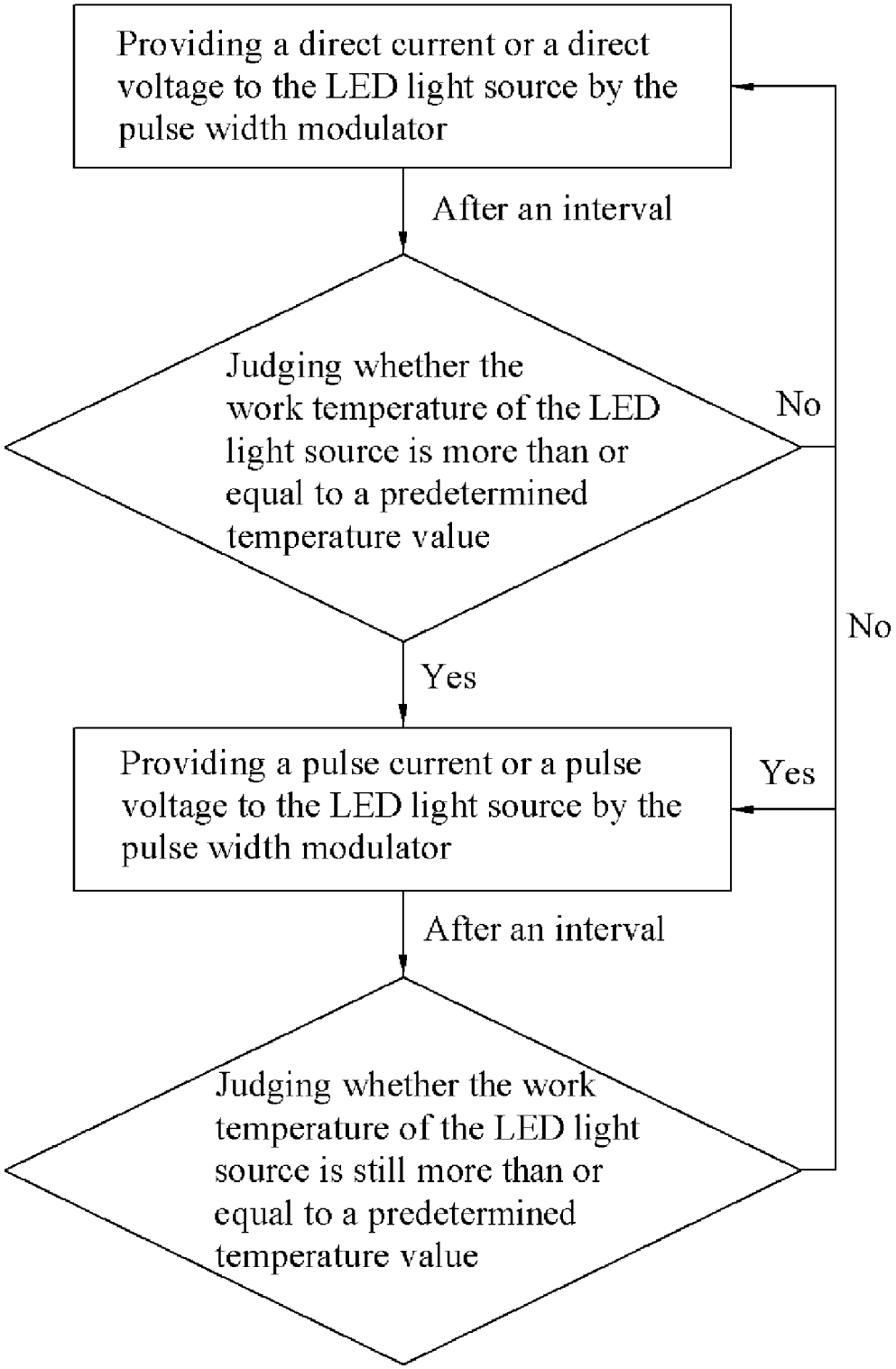
FIG. 3 is a schematic logic view of the light emitting diode illuminating device which has a temperature detector for detecting the working temperature of the LED light source intermittently.

The temperature detector 13 is not limited to detect the working temperature of the LED light source 11 all the time. Referring to FIG. 3, temperature detector 13 may also execute temperature detecting after a predetermined time period has lapsed interval. The predetermined temperature can also be set lower than 120 degree centigrade.

Figure 4:
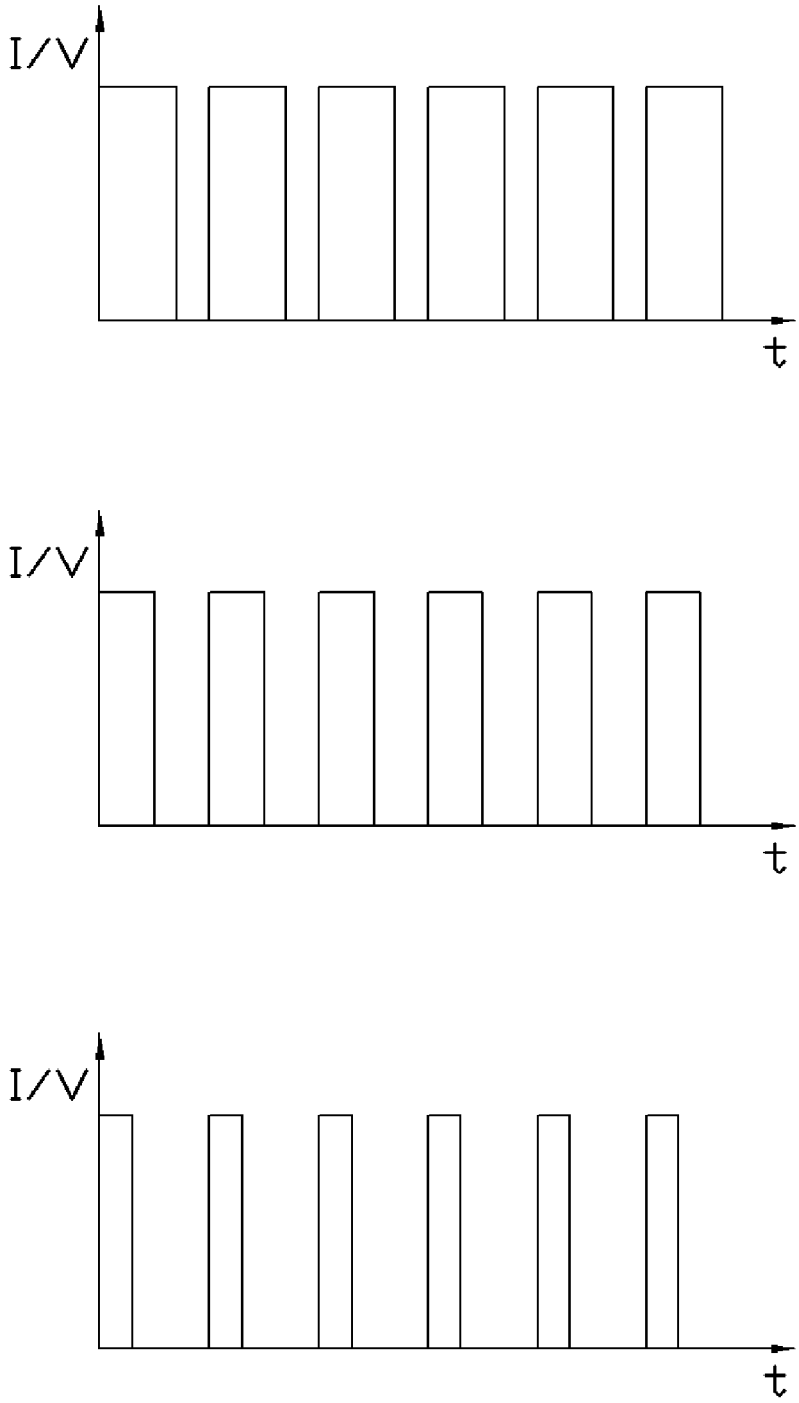
FIG. 4 is waveforms of three kinds of pulse current or voltage with different duty cycles provided by the pulse width modulator.

Additionally, the output mode of the pulse width modulator 15 may includes three pulse output mode: a first pulse output mode, a second pulse output mode and a third pulse output mode. The first pulse output mode has a duty cycle of 70%. The second pulse output mode has a duty cycle of 50%. The third pulse output mode has a duty cycle of 30%. As such, the first pulse output mode, the second pulse output mode and the third pulse output mode have descending output powers. Referring to FIG. 4, after the pulse width modulator 15 having been working in the first pulse output mode for a given time period "t" and if the working temperature of the LED light source 11 is still higher than 120 degree centigrade, the pulse width modulator 15 then switches to operate at the second pulse output mode which has a smaller output power than the first pulse output mode. After the pulse width modulator 15 having been operating at the second pulse output mode for another given time period "t" and if the working temperature of the LED light source 11 is still higher than 120 degree centigrade, the pulse width modulator 15 then switches to operate at the third pulse output mode which has a much smaller output power than the second pulse output mode.

The output mode of the pulse width modulator 15 can also have two, four, five pulse output modes or more.

Furthermore, the LED light source 11 can include a plurality of LEDs 112 and the pulse width modulator 15 can be used for providing current or voltage to some of the LEDs 112. Thereby, when some of the LEDs 112 are provided with pulse current or voltage having low duty cycle, the remainder LEDs 112 are provided with direct current or voltage. As such, the brightness of the LED light source 11 can be maintained.

Finally, it is to be understood that the above-described embodiments are intended to illustrate rather than limit the invention. Variations may be made to the embodiments without departing from the spirit of the invention as claimed. The above-described embodiment illustrates the scope of the invention but do not restrict the scope of the invention.

What is claimed is:

1. Alight emitting diode illuminating device, comprising:
- a light emitting diode (LED) light source;
- a heat dissipating device thermally connected to the LED light source;
- a temperature detector thermally connected to the LED light source, the temperature detector being configured for detecting the working temperature of the LED light source;
- a power supply; and
- a pulse width modulator, the power supply being electrically connected to the pulse width modulator for providing electric power to the pulse width modulator,
- wherein the pulse width modulator is configured for operating at a direct current (DC) output mode, if the working temperature detected by the temperature detector is lower than a predetermined temperature, where the pulse width modulator provide a direct current or a direct voltage to the LED light source; or at a pulse output mode, if the working temperature is higher than or equal to the predetermined temperature, where the pulse width modulator provide a pulse current or pulse voltage to the LED light source.

2. The light emitting diode illuminating device according to claim 1, wherein the LED light source comprises a substrate and at least one light emitting diode on the substrate, the temperature detector being mounted on the substrate or the heat dissipating device.

3. The light emitting diode illuminating device according to claim 1, wherein the temperature detector is configured for detecting the working temperature after a predetermined time period has lapsed.

4. The light emitting diode illuminating device according to claim 1, wherein the pulse output mode comprises a first pulse output mode and a second pulse output mode, the second pulse output mode having a duty cycle smaller than that of the first pulse output mode, the pulse width modulator configured for switching from the first pulse output mode to the second pulse output mode if after operating at the first pulse output mode for a given time period and the working temperature is still higher than the predetermined temperature.

5. The light emitting diode illuminating device according to claim 1, wherein the temperature detector is a thermal couple.

6. The light emitting diode illuminating device according to claim 1, wherein the predetermined temperature is lower than or equal to 120 degrees centigrade.

7. The light emitting diode illuminating device according to claim 1, wherein the pulse width modulator is configured for providing the pulse current or voltage with a frequency higher than or equal to 60 hertz when working in the pulse output mode.

8. A method for decreasing heat generation of a light emitting diode (LED) illuminating device which has a LED light source, comprising:
- detecting the working temperature of the LED light source;
- providing a first pulse current or voltage to the LED light source if the working temperature is higher than or equal to a predetermined temperature; and
- providing a direct current or direct voltage to the LED light source if the working temperature is lower than the predetermined temperature.

9. The method according to claim 8, wherein the working temperature of the LED light source is detected after a predetermined time period has lapsed.

10. The method according to claim 9, further comprising providing a second pulse current or voltage which has a duty cycle smaller than that of the first pulse current or voltage to the LED light source, if the working temperature of the LED light source is still higher than the predetermined temperature after operating in the first pulse output mode for a given time period.

* * * * *